United States Patent [19]

Hall

[11] 4,360,356

[45] Nov. 23, 1982

[54] DECURLER APPARATUS

[75] Inventor: Byron C. Hall, Dayton, Ohio

[73] Assignee: The Standard Register Company, Dayton, Ohio

[21] Appl. No.: 197,166

[22] Filed: Oct. 15, 1980

[51] Int. Cl.[3] ..... B31B 37/00; B65H 23/18; B65H 23/10

[52] U.S. Cl. ..... 493/459; 162/271; 226/39; 226/195; 242/75.2

[58] Field of Search ..... 226/195, 39; 242/75.2, 242/67.1 R, 67.2, 67.3 R, 76, 55; 162/197, 270, 271; 493/459

[56] References Cited

U.S. PATENT DOCUMENTS

| | | | |
|---|---|---|---|
| 2,070,505 | 2/1937 | Beck | 162/271 |
| 2,660,218 | 11/1953 | Johnson | 226/195 X |
| 3,552,668 | 1/1971 | Kanno | 242/76 |
| 3,604,652 | 9/1971 | Sleeper | 242/75.2 |
| 3,799,038 | 3/1974 | Bossons | 93/1 R |

OTHER PUBLICATIONS

Paper Trade Journal, Aug. 16, 1971, pp. 40 and 41, "Magnetic Curl-Breaker Straightens Curved Paper at Core Centers".

*Primary Examiner*—Edward J. McCarthy

[57] ABSTRACT

Apparatus for removing curl from a continuous moving web. The apparatus includes cylindrical members for supporting and directing the continuous web during its travel and a pair of engagement members between which the web travels. The engagement members are pivotally movable so that either surface of the web can be engaged by one of the engagement members with any desired degree of pressure for removing the curl in the continuous web during travel thereof. If the curl is upwardly, the engagement members are pivoted to engage one surface of the continuous web. If the curl is downwardly, the engagement members are pivoted to engage the opposite surface of the web. The degree of pressure applied for decurl action can be adjusted by adjusting the angle of the engagement members with respect to the line of travel of the continuous web. The apparatus also includes brush members engageable with the web to control the tensional forces upon the web as the web engages one or both of the engagement members.

16 Claims, 6 Drawing Figures

DECURLER APPARATUS

BACKGROUND OF THE INVENTION

Curl in a web may be caused by any one or more of several factors. In a printing operation, a strip of paper or the like is unwound from a roll thereof and forms a continuous web. Frequently such a web has a curl therein as it is unwound from the roll thereof.

Numerous types of printing apparatus print upon a continuous web or strip. During the printing process a web may be caused to curl.

When curl occurs, problems exist.

For example, curl in the web usually results in curl in individual sheets which are severed from the web following a printing operation. Other problems may occur in the web prior to severance thereof into individual sheets, if curl is permitted to remain in the web.

Several types of mechanisms have been employed to remove curl in a continuous web. However, none of the mechanisms designed to solve the curl problem have been completely satisfactory. Most known types of decurler mechanisms do not have adjustment capability and are therefore not capable of proper removal of curl regardless of the degree thereof.

Other known decurler devices, in an attempt to remove curl regardless of the degree thereof, sometimes scratch the web.

Another problem exists in that webs used in a printing process may be of any one of numerous thicknesses or weights or have various degrees of rigidity or flexibility.

Other problems which occur in known decurler mechanism include that in which a decurler mechanism causes wrinkle in a web.

Another problem which exists in most known decurler mechanisms is that such mechanisms are capable of removal of curl in a web only if the curl exists in a given direction in a web.

A suitable decurler is one which is capable of removing curl in a web regardless of the type or nature of the web and the degree and direction of curl therein.

BRIEF SUMMARY OF THE INVENTION

It is an object of this invention to provide apparatus which readily and properly removes curl from a continuous web during travel thereof.

Another object of this invention is to provide such apparatus which is adjustable for proper removal of curl in a web, regardless of the degree of curl in the web or regardless of the weight or nature of the web.

It is another object of this invention to provide such apparatus which properly removes curl in a continuous web without scratching the web and without wrinkling the web.

It is another object of this invention to provide such decurler apparatus which is readily adjustable to remove curl in a web in either direction in which curl may exist in a web.

Other objects and advantages of this invention reside in the construction of parts, the combination thereof, the method of production, and the mode of operation, as will become more apparent from the following description.

DETAILED DESCRIPTION OF THE INVENTION

Decurler apparatus of this invention comprises support structure in the form of side frame members 10 and 12 upon which are rotatably mounted rollers 14 and 16, which are substantially parallel, one with the other.

Also, supported by the side frame members 10 and 12 and positioned below the rollers 14 and 16 and substantially parallel thereto is a non-rotatable shaft 20.

Figure 5:
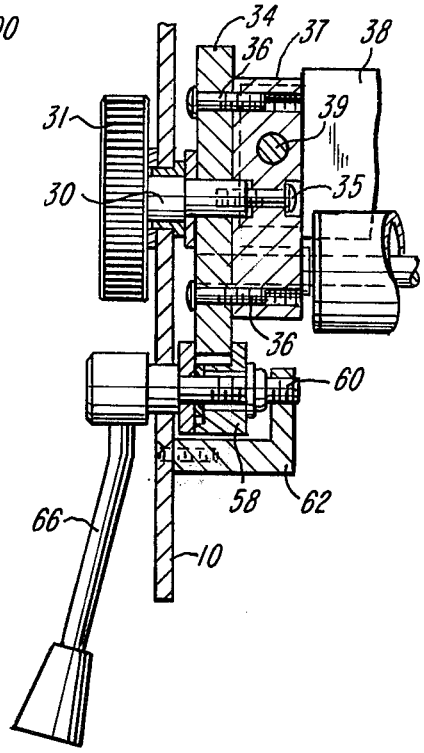
FIG. 5 is an enlarged sectional view taken substantially on line 5—5 of FIG. 1.
Figure 6:
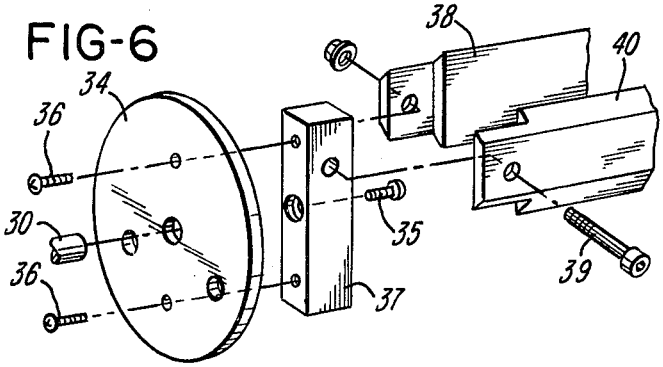
FIG. 6 is a fragmentary exploded perspective view showing a portion of the apparatus illustrated in FIG. 5.

The side frame member 10 rotatably supports a stem 30, as best shown in FIG. 5. The stem 30 extends through the side frame member 10 and has attached thereto an angle indicator and adjustment wheel 31 which carries indicia. The indicia on the wheel 31 are adapted to be used in association with an indicator marker 32 on the outer surface of the side frame member 10. Mounted on the stem 30 for rotative movement therewith is a carriage disc 34. Attached to the stem 30 and to the carriage disc 34 by a screw 35 and by screws 36 is a connector block 37. Attached to the connector block 37 by means of a bolt 39 is an elongate engagement bar 38 and an elongate engagement bar 40, as shown in FIGS. 5 and 6. Below the engagement bar 38 and rotatably carried by the carriage disc 34 is a roller 46, and below the engagement bar 40 and rotatably carried by the carriage disc 34 is a roller 48.

The engagement bars 38 and 40 extend from the connector block 37 toward the frame member 12. The side frame member 12 has a rotatable stem, not shown which supports another carriage disc 34 adjacent the side frame member 12. The engagement bars 38 and 40 are also secured to the other carriage disc 34, and the rollers 46 and 48 are rotatably carried by the other carriage disc 34. Another bolt 39 extends through the ends of the engagement bars 38 and 40 to attach the engagement bars 38 and 40 to another connector block 37.

At the lower portion of the carriage disc 34 adjacent the side frame member 10 is a clamp 58 which is supported and operated by a threaded stem 60 which is rotatably carried by a bracket 62, which is attached to the side frame member 10. A handle 66 is attached to the threaded stem 60 for rotative movement thereof. The clamp 58 is positioned at opposed portions of the carriage disc 34, and is operable to clamp the adjusted rotative position of the carriage disc 34. The clamp 58 is operated by angular movement of the handle 66.

Figure 2:
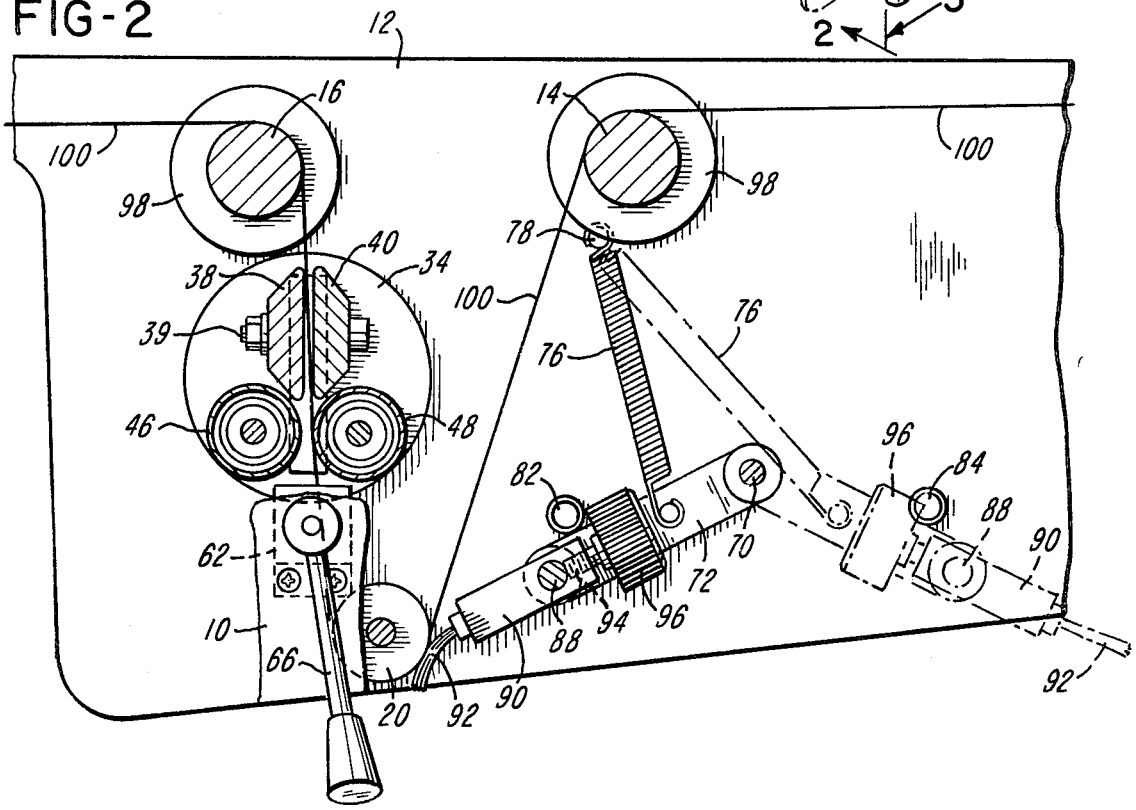
FIG. 2 is an enlarged fragmentary sectional view with parts broken away and shown in section of a portion of the decurler apparatus of FIG. 1.

As shown in FIG. 2, a stem 70 is secured to the side frame member 12 and has pivotally attached thereto an arm 72. A spring member 76 is attached to the arm 72 and to a pin 78 which is attached to the side frame member 12. An abutment member 82 is attached to the side frame member 12 adjacent the stem 70 and is engageable by the arm 72 to establish a pivotal position thereof. An abutment member 84 is also secured to the side frame member 12 adjacent the stem 70 and is engageable by the arm 72 to establish another pivotal position thereof.

Attached to the side frame member 10, but not shown, is another stem 70 which pivotally supports an arm 72. A spring member 76 is attached to the arm 72 and to the side frame member 10. An abutment member 82, not shown, is attached to the side frame member 10 adjacent the stem 70 and is engageable by another arm 72, not shown, to establish a pivotal position thereof. An abutment member 84, not shown, is also secured to the side frame member 10 adjacent the stem 70 and is engageable by the arm 72 to establish another pivotal position thereof.

Extending between the arms 72 and attached thereto is a rod 88. The rod 88 carries one or more holders 90, each of which has a brush 92 attached thereto. The rod 88 extends through each holder 90, as each holder 90 is slidably movable along the rod 88. A set screw 94 is threaded into each holder 90 and is engageable with the rod 88 to secure the holder 90 in an adjusted position with respect to the rod 88. Each set screw 94 has a relatively large head 96 for manual grasping thereof for rotative threaded movement of the set screw 94.

Figure 1:
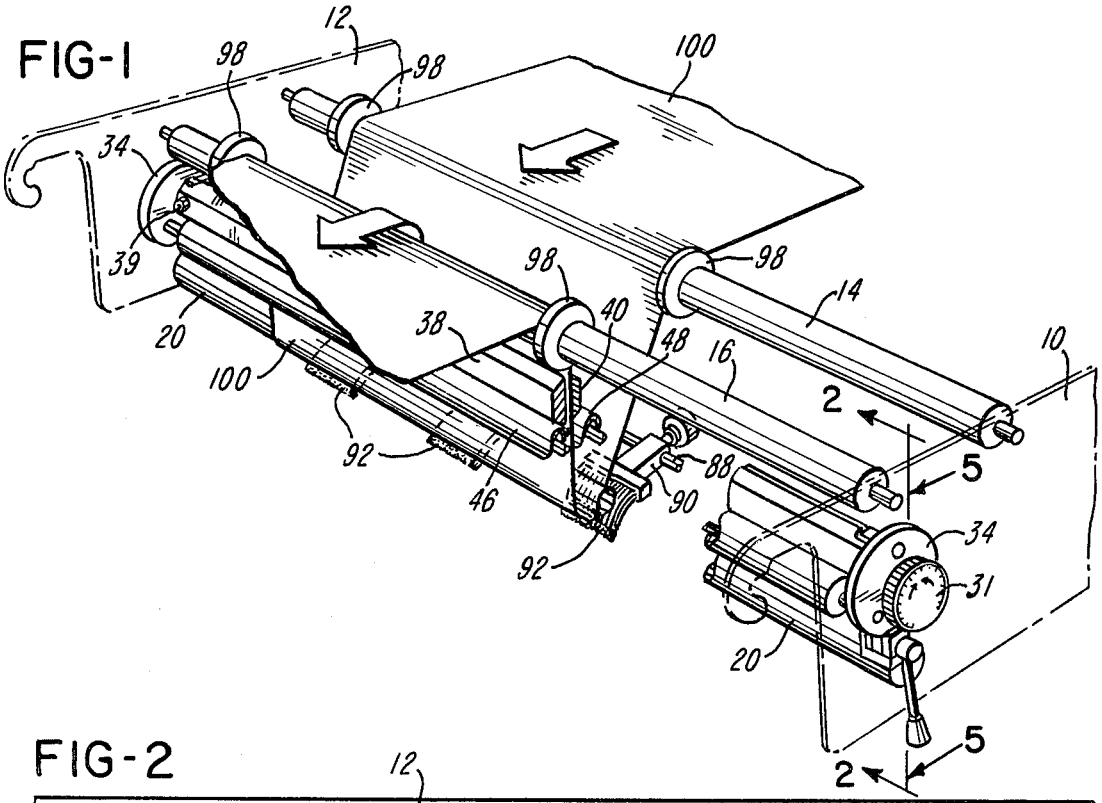
FIG. 1 is a perspective view, with parts broken away, showing decurler apparatus of this invention and a web being decurled thereby.

As shown in FIG. 1, each of the rollers 14 and 16 has a pair of spaced-apart guide members 98, encompassing the rollers 14 and 16 and carried thereby for rotation therewith. The guide members 98 are axially adjustably movable along the rollers 14 and 16 and are spaced apart a desired distance to receive a continuous web 100 therebetween. The web 100 extends over the roller 14 and then downwardly around the shaft 20. The continuous web 100 then extends between the rollers 46 and 48, which are carried by the carriage discs 34, and then the web 100 extends between the engagement bars 38 and 40, which are attached to the carriage discs 34. The web 100 then extends over the roller 16 and forwardly therefrom as the continuous web 100 is drawn forwardly by means not shown.

The continuous web 100, prior to engagement with the roller 14, may be printed upon by any suitable apparatus not shown. The web 100 may extend through a drier before the web 100 reaches the roller 14.

Figure 3:
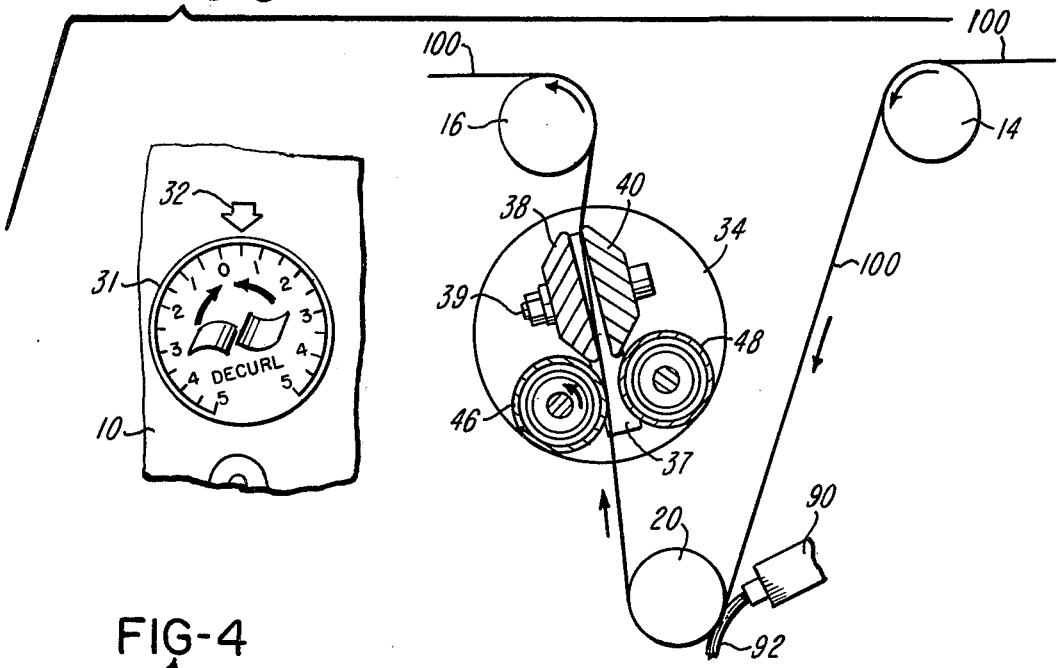
FIG. 3 is a diagrammatic sectional type of view illustrating an adjusted position of a portion of the decurler apparatus of this invention.

The web 100 may tend to curl upwardly or downwardly as the web 100 approaches the roller 14. If the web 100 tends to curl upwardly, the indicator and adjustment wheel 31 is rotated counter-clockwise to a position such as that illustrated in FIG. 3. When the wheel 31 is rotatively moved, the carriage discs 34 are also rotatively moved. Thus, the engagement bars 38 and 40 are angularly moved to the positions thereof illustrated in FIG. 3. In this angular position of the engagement bars 38 and 40, the web 100 engages the roller 46, and the lower portion of the engagement bar 38 and the upper portion of the engagement bar 40. When this occurs, the web 100 is forced in a direction such that the tendency to curl upwardly is removed. If it is found that this angle of the engagement bars 38 and 40 is not sufficient to remove the curl in the web 100, the angle of the engagement bars 38 and 40 is readily adjusted to a greater degree by further rotative movement of the adjustment wheel 31 in the counter-clockwise direction.

Figure 4:
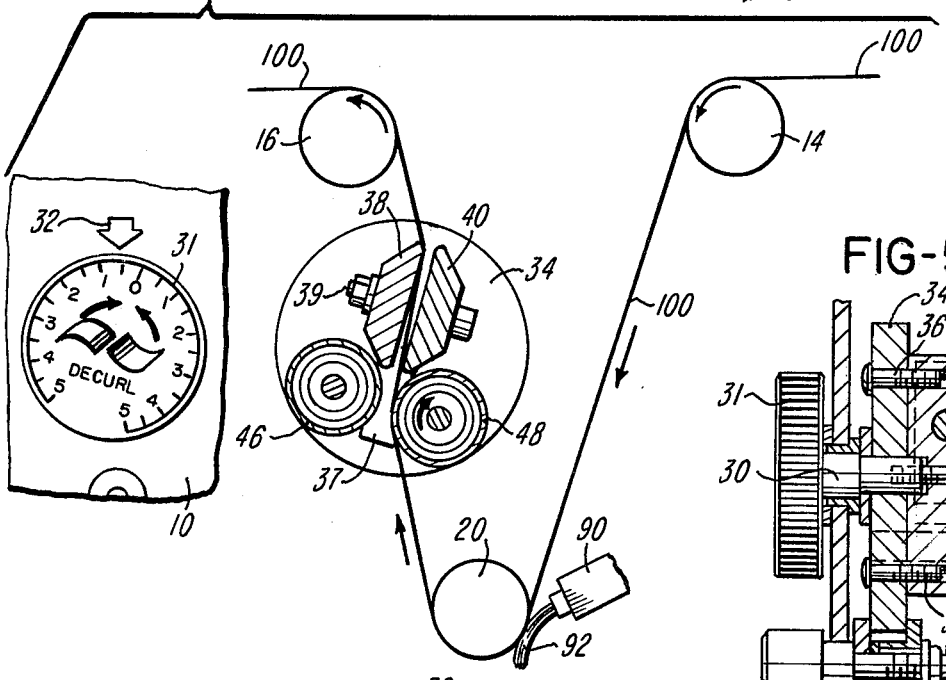
FIG. 4 is a diagrammatic sectional type of view illustrating a different adjusted position of the portion of the decurler apparatus shown in FIG. 3.

If it should be found that as the web 100 travels in the manner illustrated in FIG. 1, the web 100 tends to curl downwardly, the wheel 31 is rotatively moved in a clockwise direction, for example to an angle such as that illustrated in FIG. 4. Prior to rotative movement of the carriage disc 34 the clamp 58 is released from clamping action upon the carriage disc 34 which is adjacent the side frame member 10. As stated above, clamping and unclamping action of the clamp 58 upon the carriage disc 34 is controlled by angular movement of the handle 66. Thus, the carriage disc 34 are rotatively moved, and the engagement bars 38 and 40 are angularly moved and the rollers 46 and 48 are positioned as illustrated in FIG. 4. Thus, the moving web 100 engages the roller 48 and the lower portion of the engagement bar 40 and the upper portion of the engagement bar 38. Thus, the tendency in the web 100 to curl downwardly is removed.

In order to effectively remove curl in the web 100, some degree of tension must be placed upon the web 100 between the shaft 20 and the roller 16. The degree of such tension required depends upon any one or more of several factors, such as the type of the web 100 and the degree of curl in the web 100. To increase such tension, one or more brushes 92 may be placed into engagement with the web 100 as the web 100 engages the shaft 20, as illustrated in FIG. 2. If it is found that too much tension exists between the shaft 20 and the roller 16, one or more brushes 92 may be removed from engagement with the web 100. Such removal is accomplished by moving one or more brushes 92 axially and/or angularly upon the rod 88. For removal of all of the brushes 92 from engagement with the web 100, the rod 88 is moved to the broken line position thereof, as illustrated in FIG. 2.

Each of the brushes 92 may be moved axially along the rod 88 after release of the set screw 94 from engagement with the rod 88.

Thus, it is understood that the decurler apparatus of this invention is capable of removal of curl in a continuous web 100 regardless of the direction of curl and regardless of the degree of curl and regardless of the physical nature of the web 100.

Although the preferred embodiment of the decurler apparatus of this invention has been described, it will be understood that within the purview of this invention various changes may be made in the form, details, proportion and arrangement of parts, the combination thereof, and the mode of operation, which generally stated consist in a structure within the scope of the appended claims.

The invention having thus been described, the following is claimed:

1. Apparatus for removing curl from a continuously moving web, comprising a first roller, a second roller, the rollers being in spaced-apart substantially parallel relationship, a shaft spaced from the rollers and substantially parallel thereto, a pair of closely spaced engagement bars positioned between the shaft and the second roller, the engagement bars being angularly movable about an axis which is adjacent the engagement bars, the apparatus being adapted to receive a continuous web which extends partially around the first roller, then partially around the shaft, then between the engagement bars, and then partially around the second roller, at least one of the engagement bars being engaged by the web for applying pressure upon the web to remove the curl therefrom.

2. The apparatus of claim 1 which includes rotative carriage means supporting the engagement bars and rotatively movable to angularly adjustably position the engagement bars with respect to the web.

3. The apparatus of claim 2 which includes a clamp member engageable with the carriage means to retain the rotative position thereof.

4. The apparatus of claim 1 which includes a brush member movable toward and away from the shaft for engagement of the brush member with the web as the web engages the shaft to apply pressure upon the web and to create tension in the web between the shaft and the second roller.

5. The apparatus of claim 1 in which the shaft is non-rotatable.

6. Apparatus for removing curl in a continuous moving web, comprising:

a rotatable carriage, a pair of closely spaced elongate engagement bars, means attaching the engagement bars to the rotatable carriage for an angular movement with rotative movement of the carriage, the closely spaced elongate engagement bars forming a slot of given width and length dimensions through which the web travels, the engagement bars being angularly movable in one direction with rotative movement of the carriage so that as the web travels through the slot the web is engageable with a portion of one of the elongate bars to remove curl which exists in one direction in the web, the engagement bars being angularly movable in the opposite direction with rotative movement of the carriage so that the web is engageable with a portion of the other elongate bar to remove curl which exists in the opposite direction in the web, a pair of spaced-apart web contact members attached to the carriage and movable therewith, the web extending between the web contact members and then to the engagement bars, as the contact members direct the web to the engagement bars, the contact members being positioned to limit the area of engagement of the web with the engagement bars.

7. The apparatus of claim 6 which includes a shaft over which the web travels, and stationary adjustable pressure means for engaging the web and for forcing the web against the shaft for creating tension in the web as the web travels through the slot formed between the engagement bars.

8. The apparatus of claim 6 which includes means for securing the rotative position of the carriage means.

9. The apparatus of claim 6 in which the contact members comprise a pair of spaced-apart rollers supported by the carriage adjacent the elongate engagement bars, the rollers being positioned to receive the moving web therebetween as the moving web travels toward the engagement bars, one of the rollers being engaged by the moving web as the moving web engages one of the engagement bars, the other roller being engaged by the moving web as the moving web engages the other engagement bar.

10. The apparatus of claim 6 which includes a pair of spaced-apart roller members and a shaft spaced from the roller members, the web being in engagement with both of the roller members and the shaft, the engagement bars being positioned between the shaft and one of the roller members, with the web extending from one roller member to the shaft, then from the shaft to the engagement bars and then to the other roller member.

11. The apparatus of claim 10 in which the shaft is non-rotatable.

12. Apparatus for removing curl in a continuous moving web comprising:

a carriage member angularly movable about a given axis, an elongate engagement member attached to the carriage member for angular movement with angular movement of the carriage member, the elongate engagement member having two closely spaced portions forming an elongate slot therebetween of given width and length dimensions through which the web travels, the elongate slot having closely spaced opposed engagement walls, roller means having spaced-apart portions rotatively supported by the carriage member adjacent the engagement member and movable with angular movement of the carriage member, the carriage member being angularly movable in a counter-clockwise direction to angularly move the engagement member in a counter-clockwise direction for engagement of the web with a portion of the roller means and with a portion of the engagement member to remove curl which exists in a given direction in the web, the carriage member being rotatively movable in a clockwise direction to pivotally move the engagement member in a clockwise direction for engagement of the web with another portion of the roller means and with another portion of the engagement member to remove curl from the web which exists in a direction opposite from the given direction.

13. The apparatus of claim 12 in which the roller means comprises a pair of spaced-apart roller members.

14. Apparatus for removing curl in a continuous moving web comprising:

a carriage member angularly movable about a given axis, an elongate engagement member attached to the carriage member for pivotal movement with rotative movement of the carriage member, the elongate engagement member having two closely spaced portions forming an elongate slot therebetween of given width and length dimensions through which the web travels, the elongate slot having closely spaced opposed engagement walls, spaced-apart roller means rotatively supported by the carriage member adjacent the engagement member and movable with angular movement of the carriage member, the carriage member being angularly movable in a counter-clockwise direction to pivotally move the engagement member in a counter-clockwise direction for engagement of the web with a portion of the roller means and with a portion of the engagement member to remove curl which exists in a given direction in the web, the carriage member being angularly movable in a clockwise direction to pivotally move the engagement bar in a clockwise direction for engagement of the web with another portion of the roller means and with another portion of the engagement member to remove curl from the web which exists in a direction opposite from the given direction, the apparatus also including an adjustment and indicator member operably attached to the carriage member for rotative adjustment thereof and for indicating the rotative adjusted position thereof.

15. The apparatus of claim 14 which includes means for securing the rotative adjusted position of the carriage member.

16. Apparatus for removing curl in a continuous moving web comprising: a carriage member rotatable upon a given axis, an elongate engagement member attached to the carriage member for pivotal movement with rotative movement of the carriage member, the elongate engagement member having two closely spaced portions forming an elongate slot therebetween through which the web travels, the carriage member being rotatively movable in a counter-clockwise direction to pivotally move the engagement member in a counter-clockwise direction for engagement of the engagement member with one surface of the web to remove curl which exists in a given direction in the web, the carriage member being rotatively movable in a clockwise direction to pivotally move the engagement member in a clockwise direction for engagement with the opposite surface of the web to remove curl from the web which exists in direction opposite from the given direction.

* * * * *